United States Patent [19]

Gray et al.

[11] 4,306,263

[45] Dec. 15, 1981

[54] SYNCHRONOUS CLOSING SYSTEM AND LATCH THEREFOR

[75] Inventors: Keith I. Gray, LaVerne; David S. Johnson, Downey, both of Calif.

[73] Assignee: Gould Inc., Rolling Meadows, Ill.

[21] Appl. No.: 135,090

[22] Filed: Mar. 28, 1980

[51] Int. Cl.[3] ..... H01H 9/56

[52] U.S. Cl. ..... 361/3; 200/82 B; 200/144 AP

[58] Field of Search ..... 361/3, 5, 6; 200/82 B, 200/144 AP; 335/19.62

[56] References Cited

U.S. PATENT DOCUMENTS 3,566,152 2/1971 Casey ..... 361/6

3,808,455 4/1974 Leisi ..... 361/3

*Primary Examiner*—Harry E. Moose, Jr.

*Attorney, Agent, or Firm*—Ostrolenk, Faber, Gerb & Soffen

[57] ABSTRACT

A synchronous closing system for high voltage circuit breakers is disclosed wherein the circuit breaker main contacts close within about 1 millisecond of a current zero in the current through a closing resistor in a 60 hertz system. Closing accuracy is obtained by delaying the release of a latch which holds the closing system for a given delay following the appearance of a closing signal, which delay enables hydraulic operating pressures to come to full value before permitting the hydraulic operation of the closing piston. The latch release instant is controlled from a signal derived from a zero cross-monitor circuit, which monitors resistor current and releases the latch at a time which allows contact closing at a subsequent current zero. The closing mechanism may be slightly jogged before full motion and during the delay time.

11 Claims, 5 Drawing Figures

SYNCHRONOUS CLOSING SYSTEM AND LATCH THEREFOR

BACKGROUND OF THE INVENTION

This invention relates to circuit breaker closing systems, and more specifically relates to a novel synchronous closing system for extra-high voltage circuit breakers.

It is known that extra-high voltage circuit breakers, for example, those operating in lines of 550 kV or more should preferably be closed in synchronism with the closing resistor current zero. This will limit switching surge overvoltages on the line due to trapped charges on the line and due to the main contact shunting by a closing resistor.

To obtain synchronism between the contact closing and the current zero, it is known to provide zero cross-detection systems which monitor the resistor current and which produce closing signals which are applied to hydraulic operating mechanisms for the circuit breaker with a timing such that the hydraulic operating mechanism will close the circuit breaker contacts at an instant in a two millisecond "window" around a zero current.

It has been found that such systems do not give good repeatability. Variable closing instants have been found to be caused by changes in ambient temperature, inconsistency in the operation of the control valve, inconsistency in the movement of the piston, and variations in the control voltage controlling the various elecrtrical relays and other components in the system. In particular, it was found that the rate of rise of pressure for operating the pneumatic piston varied considerably and this caused variable and unpredictable changes in the closing instant which were, in some cases, unacceptably greater than the desired two millisecond window for closing around the zero current instant.

BRIEF DESCRIPTION OF THE INVENTION

In accordance with the present invention, the operating piston which operates the contacts can be latched against movement by the force of its hydraulic fluid until the latch is released. The piston is then held latched following the initiation of an operating signal calling for circuit breaker closure for a given time delay to enable piston pressure to come up to a high enough value to cause a consistent operation of the piston after the latch is released. A 50 millisecond delay has been found satisfactory for this purpose, although any desired delay could be used. After the delay period has elapsed, the latch is released by a conventional zero cross-section circuit to produce circuit breaker contact closing at or near a subsequent zero cross instant.

By delaying the operation of the piston until operating pressure has built up, variation in closing time due to variable pressure on the piston is eliminated. Moreover, the delay ensures sufficient pressure to place the system immediately into a dynamic friction mode of operation so that a very consistent travel curve for the contacts is obtained.

When carrying out the invention, it is also possible to cause the piston system to "jog" slightly during the 50 millisecond delay in order to overcome static friction effects within the piston system. However, the invention can be carried out in the absence of this intermediate jog feature.

The invention as described provides highly consistent closing times to accomplish synchronous closing of circuit breaker contacts. However, its execution is not limited to synchronous closing and it may be used for the closing of circuit breaker contacts at any preferred time on a 60 cycle wave with respect to the zero-crossing.

DETAILED DESCRIPTION OF THE DRAWINGS

Figure 2:
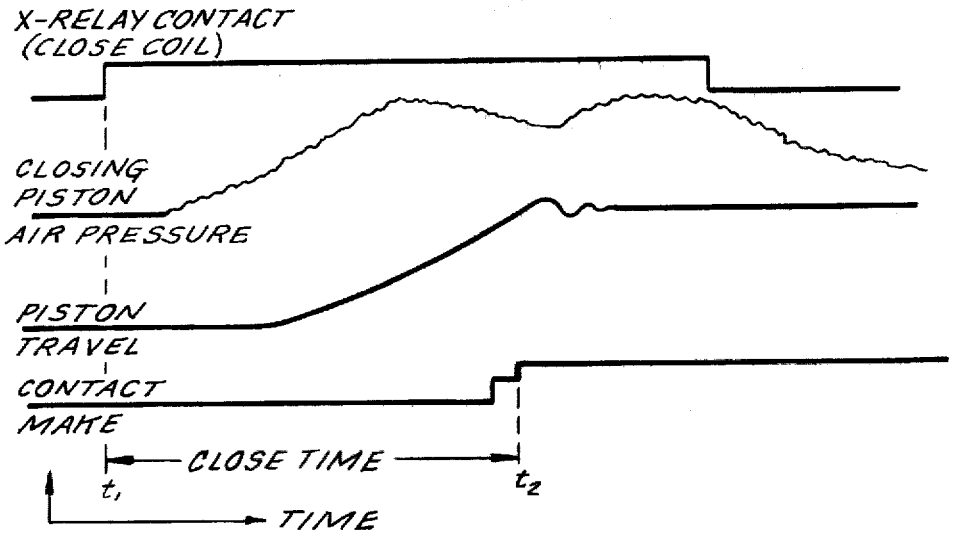
FIG. 2. (PRIOR ART)
FIG. 2 shows timing curves and travel curves of the principal components of the closing system in a prior art type of circuit breaker.

Referring first to FIG. 2, there is illustrated therein the characteristics of a prior art closing system. The prior art closing system uses a a conventional hydraulic circuit breaker hydraulic operating system wherein a pneumatic piston is mechanically connected to the movable contact structure of a circuit breaker and the circuit breaker contacts are closed by pressurizing the piston, thereby forcing it to move in its containing cylinder to close the contacts.

The cylinder is placed under pressure by the opening of a solenoid valve. This solenoid valve is, in turn, opened by the operation of a so-called x-relay contact which is a contact in the circuit breaker control mechanism.

In FIG. 2, the upper line shows the condition of the x-relay contact and it will be seen that the relay contact is closed at time t1 in order to energize a solenoid valve relay which pressurizes the operating piston. The second line in FIG. 2 shows the buildup in fluid pressure in the cylinder containing and operating a piston. It will be seen that after time t1, the piston pressure begins to build toward its desired operating value. As the pressure behind the piston increases, the piston itself begins to move as shown in its travel curve which is the third line in FIG. 2 and the main contacts of the circuit breaker begin to travel and ultimately close under the influence of the piston at time t2.

The conventional mechanism described in FIG. 2 has been operated synchronously to cause the main contacts to close at a time t2 which is at or near closing resistor current zero in the system to avoid high closing surge voltage on the system. Conventionally, synchronization is obtained by coupling a zero cross-detection circuit to the line and by causing the zero cross-detection circuit to operate the x-relay coil at some instant t1 which will produce the closing at time t2, with time t2 as near as possible to a zero crossing instant. The time following the first zero crossing instant until a signal should be put out by the detector to initiate the closing operation, so that the contacts will close on a subsequent zero crossing instant, can be easily calculated.

It has been found that in the prior art system of FIG. 2, the actual closing instant t2 is not consistent and falls in a window of about 5 milliseconds around a zero current instant in a 60 hertz system. This closing window is too large for stable circuit conditions and it would be preferable that contact closing occurs in a window of about 2 milliseconds for good circuit stability.

One of the reasons for closing inconsistency in prior art devices is the irregular piston travel and irregular buildup of the air pressure to operate the closing piston. These variations are due, in part, to uncontrolled friction characteristics within the piston closing mechanism as well as irregular valve operation.

In accordance with the present invention and as is described in FIGS. 1 and 3, a novel closing latch is connected to the operating piston and a novel delay circuit is provided to prevent the actuation of the closing latch and operating piston for some given time delay after a desired signal in order to allow the piston pressure to reach a stable value which will ensure consistent piston operation when the piston is subsequently released by the latch by a zero cross-actuated release circuit.

Figure 1:
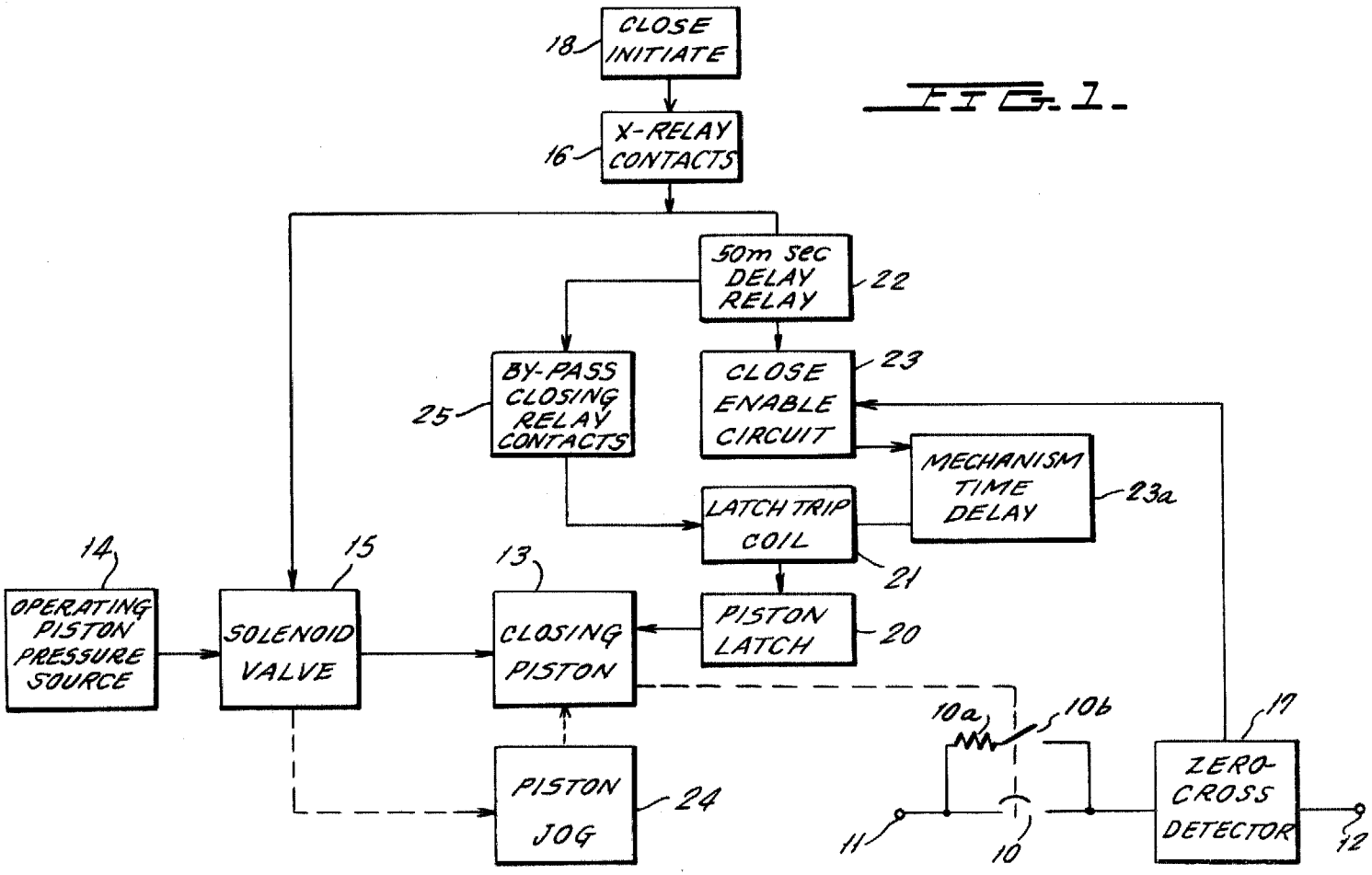
FIG. 1 is block diagram of the novel system of the invention.

FIG. 1 is a schematic block diagram of the novel closing system of the invention and shows a single phase of a multiphase high voltage circuit breaker having main contacts 10 connected between terminals 11 and 12. A closing resistor 10*a* in series with closing contacts 10*b* is closed in advance of contacts 10 in a conventional manner. Obviously, the invention will be applied to each phase of a multiphase circuit breaker. Contact 10 is operated by a conventional closing piston 13. Piston 13 is contained in a hydraulic cylinder which can be filled with high pressure air or other fluid from an operating piston pressure source 14 through a solenoid valve 15 which can be opened when it is desired to operate closing piston 13. The solenoid valve 15 is, in turn, operated by x-relay 16 which receives its operating signal ultimately from the close initiate 18.

In accordance with the invention, the closing piston 13 is latched by a piston latch 20 shown in FIG. 1, where the piston latch 20 prevents the closing piston 13 from closing contact 10 even though solenoid valve 15 is open and pressure from the pressure source 14 is increasing behind the closing piston 13.

The piston latch 20 is controlled, in turn, by a latch trip coil 21 and the latch trip coil 21 is operated by 50 millisecond delay relay 22, close enable circuit 23 and mechanism time delay circuit 23*a*. More specifically, after close initiate 18 operates, x-relay contacts 16 close and 50 millisecond delay relay 22 begins to time. At the end of the 50 millisecond delay, relay 22 applies an enable signal to close enable circuit 23. When a zero cross-signal is also applied to close enable circuit 23, it fires to trigger mechanism time delay circuit 23*a* which times out for a given time. This given time is the delay needed after a zero cross to operate coil 21 in order that the contact 10 will close at a subsequent zero instant in the closing resistor current.

By the time the circuit 23*a* times out and produces a signal to operate coil 21, the closing piston will have been well pressurized and ready to produce a consistent closing operation. That is, by latching the closing piston 13 and preventing its operation for some given period of time such as 50 milliseconds or some other suitable delay, it is assured that the pressure behind closing piston 13 will reach a sufficiently high value that when the piston latch 20 is released, extremely consistent closing times are obtained for the contacts 10. This consistent operation is demonstrated in FIG. 3.

Figure 3:
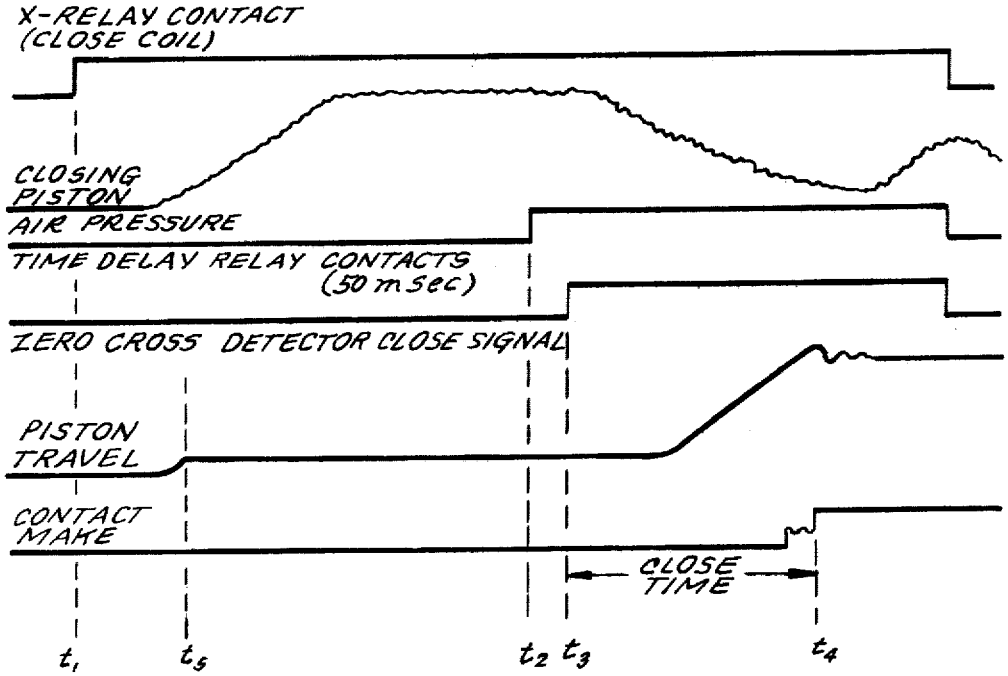
FIG. 3 shows timing and travel curves similar to those of FIG. 2 when using the novel system and closing latch of the present invention.

Thus, in FIG. 3, the x-relay 16 is operated at time t1. Note that the operation of relay 16 need not be synchronized with a voltage or current zero, and can be operated by close-initiate circuit 18*a*. Relay 16 then operates valve 15 to permit high pressure fluid from fluid source 14 to flow into the cylinder confining closing piston 13 and permits the buildup of piston pressure to some peak value as shown in the second line in FIG. 3. Note that during this time, piston travel is not started, except for a small "jog" to be later described.

Beginning at time t1 in FIG. 3, the 50 millisecond delay relay 22 also begins to time as shown in the third line in FIG. 3 and it produces an output pulse at time t2 which is 50 milliseconds later than time t1.

With the operation of the 50 millisecond delay relay 22, a first input is applied the close-enable circuit 23. A second input from the zero cross-detector 17 is applied at the first zero cross instant following t2 to begin the timing of delay 23*a*. Delay circuit 23*a* produces a signal at time t3 which is the time at which coil 21 should be energized to ensure that contact 10 will close on a subsequent zero voltage instant. Thus, the closing signal for latch trip coil 21 is applied at a time t3, labeled the zero cross detector close signal in FIG. 3.

The operation of coil 21 and the release of the piston latch 20 then permits the closing piston 13, which is pre-pressurized, and causes the closing of the contact 10 at time t4, which is a zero voltage instant in the bus current wave form.

To make the closing times more consistent, the closing piston 13 may be initially jogged or caused to move a short distance, for example, $\frac{1}{8}$ to $\frac{1}{4}$ inch as compared to full piston travel of about 2 inches, to ensure that the entire mechanism is free to operate when the piston latch 20 is ultimately released. To this end, any suitable jogging mechanism, schematically illustrated in FIG. 1 as the piston jog block 24, can be applied to the closing piston 13 and can be energized through the solenoid valve 15. The slight piston jog travel is shown in the piston travel curve in FIG. 3 as a slight movement just prior the time t5. After the short initial motion of $\frac{1}{8}$ to $\frac{1}{4}$ inch, the piston sits in that position until it is fully released by the piston latch 20 at time t3.

If non-synchronous operation is desired, the close enable circuit 23 and mechanism time delay 23*a* can be bypassed through the bypass closing relay contacts 25. In this event the latch trip coil 21 is energized immediately after time out of the 50 millisecond delay relay 22, releasing piston latch 20 and allowing closing piston 13 to close breaker contacts 10. Suitable operating means (not shown) will close bypass closing relay contacts 25 when bypass operation is desired.

Figure 4:
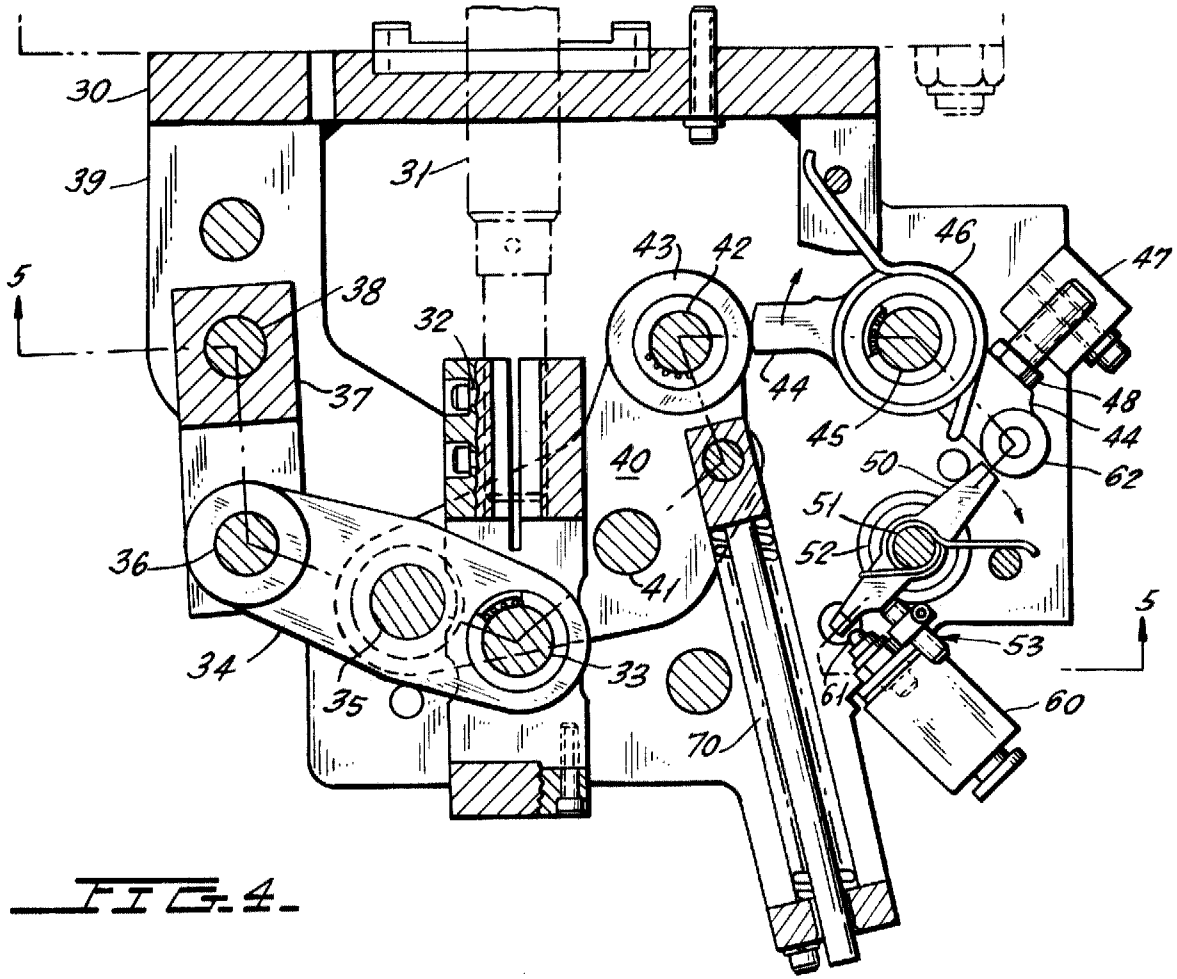
FIG. 4 is a cross-sectional view of a latch mechanism assembly which can be applied to a conventional operating piston for a high voltage circuit breaker.
Figure 5:
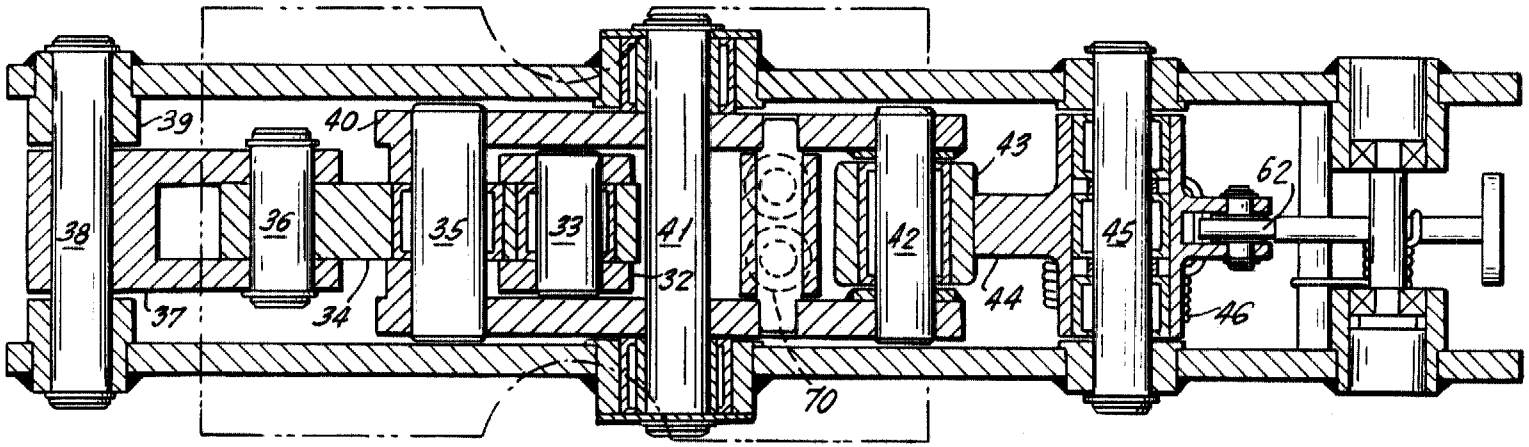
FIG. 5 is a cross-sectional view of FIG. 4 taken across the section line 5—5 in FIG. 4.

One typical novel latch mechanism which could be used for latch 20 is shown in FIGS. 4 and 5 in cross-sectional view. The piston mechanism of FIG. 4 is connected to the bottom of a conventional piston cylinder 30 which has a piston rod 31 extending from a piston trapped in the cylinder body and moves under the influence of high pressure air which is applied to the cylinder. The piston rod 31 in FIGS. 4 and 5 is shown in its latched position and in a position in which the contacts operated by rod 31 are open.

The piston rod 31 has its bottom end connected to a suitable coupling 32 which receives a pivot pin 33. Pivot pin 33 receives one end of a crank 34 which carries a movable pivot 35. The opposite end of crank 34 is pivotally connected by pin 36 to link 37 which is pivotally connected by pin 38 to the fixed bracket 39.

Pin 35 of link 34 receives one end of link 40 which is pivotally mounted on a fixed pivot 41. One end of member 40 is pinned to the pin 35 and its other end carries a pin 42 which carries a roller 43 which can be latched by the main latch member 44 rotatably mounted on the fixed pin 45. Latch 44 is biased by the spring 46 against stop assembly 47 having an adjustable stop screw 48. The stop screw 48 receives the main latch 44 which is latched by a secondary latch 50 mounted on fixed pivot 51 (FIG. 4) and biased by the biasing spring 52 against the stop assembly 53.

A trip coil 60 is then provided having a plunger 61 which is operable to rotate latch 50 to release roller 62 of main latch 44, thereby to permit latch 44 to rotate clockwise to release roller 43. Member 40 is then biased clockwise about pivot 41 against the spring assembly 70 by the main piston and, upon release of the latch 44, member 40 rotates clockwise about pivot 41 to release the toggle formed between links 34 and 40 and to enable the high speed movement of the piston rod 31 under the force of the air pressure within the cylinder containing the piston. After closing, spring assembly 70 resets the latch mechanism.

While the latch mechanism of FIGS. 4 and 5 is a preferred latch structure and has given good operation, it will be apparent to those skilled in the art that the latch structure disclosed is only one of many latches which could be employed. Moreover, the novel invention could be carried out with numerous other contact closing arrangements using the basic concept of the invention which is to delay the operation of the circuit breaker operating mechanism until the hydraulic system has been brought to pressure in response to an initial operating signal.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A synchronous closing circuit for a hydraulically operated circuit breaker; said circuit breaker having a pair of contacts connected in an electrical system; a piston connected to said contacts for operating said contacts to a closed position; a pressure source for operating said piston; electrically operable valve means for connecting said pressure source to said piston; a latch mechanism connected to said piston and being operable from a latched position holding said piston in a position in which said contacts are open to an unlatched position at which said piston can move to close said contacts; and synchronous circuit means operable to produce an output signal having a given time relation to a point on the wave shape of one of the voltage or current of said electrical system so that said latch mechanism is unlatched at a time which ensures contact closure near to or at a subsequent predetermined point on said wave shape zero current instant of said electrical system.

2. The circuit of claim 1 which further includes second circuit means for operating said electrically operable valve means and third circuit means for delaying the release of said latch mechanism for a given time delay after the operation of said electrically operable valve means.

3. The circuit of claim 2 wherein said given time delay is about 50 milliseconds and wherein said electrical system has a frequency of 60 hertz.

4. The circuit of claim 1, 2 or 3 wherein said circuit breaker has a voltage rating of about 550,000 volts

5. The circuit of claim 1, 2 or 3 which further includes jogging means for producing limited motion of said piston during said time delay.

6. The circuit of claim 5 wherein said jogging means causes said piston to move less than about ¼ inch.

7. The circuit of claim 1 or 2 wherein said contacts close consistently in an interval of about 2 milliseconds.

8. The method of closing a circuit breaker synchronously with a zero current instant in the current of the circuit containing said circuit breaker; said method comprising: connecting a resistor in parallel with the main contacts of said circuit breaker; detecting the occurrence of zero resistor current crossings of said circuit; applying hydraulic pressure to an operating piston which closes said circuit breaker while said piston is latched against substantial motion; releasing said latch at a time after hydraulic pressure has increased above a given value, and at a time which will cause the contacts of said circuit breaker to close at an instant near current zero.

9. The method of claim 8 wherein said contacts close constantly in an interval of about 2 milliseconds which includes a system current zero.

10. The method of closing a circuit breaker at any preferred point on a 60 HZ wave with respect to the zero crossing of one of the voltage or current of an electrical system containing said circuit breaker; said method comprising: applying hydraulic pressure to an operating piston which closes said circuit breaker while said piston is latched against substantial motion; allowing hydraulic pressure to build above a certain value and stabilize; detecting a zero-crossing of the voltage or current of said electrical system; releasing said latch at a time which will cause the contacts of said circuit breaker to close at a subsequent and preferred instant with respect to a subsequent system zero-crossing.

11. The method of claim 10 wherein said contacts close constantly in an interval of about 2 milliseconds which includes the preferred instant with respect to said system zero-crossing.

* * * * *